US010815547B2

(12) United States Patent
Kizu et al.

(10) Patent No.: US 10,815,547 B2
(45) Date of Patent: Oct. 27, 2020

(54) HIGH STRENGTH STEEL SHEET AND MANUFACTURING METHOD THEREFOR

(71) Applicant: JFE STEEL CORPORATION, Chiyoda-ku, Tokyo (JP)

(72) Inventors: Taro Kizu, Tokyo (JP); Shunsuke Toyoda, Tokyo (JP); Akimasa Kido, Tokyo (JP); Tetsushi Tadani, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 590 days.

(21) Appl. No.: 15/554,821

(22) PCT Filed: Mar. 1, 2016

(86) PCT No.: PCT/JP2016/001107
§ 371 (c)(1),
(2) Date: Aug. 31, 2017

(87) PCT Pub. No.: WO2016/143298
PCT Pub. Date: Sep. 15, 2016

(65) Prior Publication Data

US 2018/0016657 A1 Jan. 18, 2018

(30) Foreign Application Priority Data

Mar. 6, 2015 (JP) ..... 2015-044608

(51) Int. Cl.
*C21D 9/46* (2006.01)
*C22C 38/14* (2006.01)
(Continued)

(52) U.S. Cl.
CPC ..... *C21D 9/46* (2013.01); *C21D 8/0205* (2013.01); *C21D 8/0226* (2013.01); *C22C 38/00* (2013.01);
(Continued)

(58) Field of Classification Search
CPC ..... C21D 9/46; C21D 8/0226; C21D 8/0205; C21D 2211/005; C22C 38/00;
(Continued)

(56) References Cited

U.S. PATENT DOCUMENTS 7,686,896 B2 3/2010 Yoshida et al.
9,212,411 B2 12/2015 Nakagawa et al.
(Continued)

FOREIGN PATENT DOCUMENTS

CN 102471844 A 5/2012
CN 102517493 A 6/2012
(Continued)

OTHER PUBLICATIONS

JP 2007-016319A, Kikuchi. Machine translation (Year: 2007).*
(Continued)

*Primary Examiner* — John A Hevey
(74) *Attorney, Agent, or Firm* — Kenja IP Law PC

(57) ABSTRACT

A high strength steel sheet having high strength such as a tensile strength of 780 MPa or more and having excellent blanking workability and stretch flangeability and a manufacturing method therefor are provided. A high strength steel sheet comprises: a chemical composition containing, in mass %, C: 0.05% to 0.30%, Si: 0.6% to 2.0%, Mn: 1.3% to 3.0%, P: 0.10% or less, S: 0.030% or less, Al: 2.0% or less, N: 0.010% or less, and one or more of Ti, Nb, and V: 0.01% to 1.0% each, with a balance being Fe and incidental impurities; a ferrite microstructure of 50% or more in area ratio; an amount of precipitated Fe of 0.04 mass % or more; and a precipitate with a particle size of less than 20 nm, wherein C* and $C^*_p$ satisfy specific conditions.

6 Claims, 3 Drawing Sheets

(51) Int. Cl.

| | |
|---|---|
| ***C22C 38/60*** | (2006.01) |
| ***C22C 38/00*** | (2006.01) |
| ***C21D 8/02*** | (2006.01) |
| ***C22C 38/06*** | (2006.01) |
| ***C22C 38/12*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/58*** | (2006.01) |

(52) U.S. Cl.
CPC ..... *C22C 38/06* (2013.01); *C22C 38/12* (2013.01); *C22C 38/14* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C22C 38/60* (2013.01); *C21D 2211/005* (2013.01)

(58) Field of Classification Search
CPC ..... C22C 38/58; C22C 38/50; C22C 38/48; C22C 38/46; C22C 38/44; C22C 38/42; C22C 38/12; C22C 38/06; C22C 38/60; C22C 38/14
See application file for complete search history.

(56) References Cited

U.S. PATENT DOCUMENTS

| | | | | |
|---|---|---|---|---|
| 9,689,060 | B2 | 6/2017 | Murakami et al. | |
| 9,765,413 | B2 | 9/2017 | Kawasaki et al. | |
| 2012/0107633 | A1 | 5/2012 | Nakagawa et al. | |
| 2018/0155806 | A1* | 6/2018 | Kizu | C21D 8/0226 |
| 2019/0309396 | A1* | 10/2019 | Kizu | C21D 8/0263 |

FOREIGN PATENT DOCUMENTS

| | | | | |
|---|---|---|---|---|
| CN | 103003460 | A | | 3/2013 |
| CN | 103732779 | A | | 4/2014 |
| EP | 2746417 | A1 | | 6/2014 |
| JP | H11189842 | A | | 7/1999 |
| JP | 2007016319 | A | * | 1/2007 |
| JP | 2007247049 | A | | 9/2007 |
| JP | 2008261029 | A | | 10/2008 |
| JP | 2009167475 | A | | 7/2009 |
| JP | 2009191360 | A | | 8/2009 |
| JP | 2009280899 | A | | 12/2009 |
| JP | 2011012308 | A | | 1/2011 |
| JP | 2011017060 | A | | 1/2011 |
| JP | 2011068945 | A | | 4/2011 |
| JP | 2011225938 | A | | 11/2011 |
| JP | 2012001776 | A | | 1/2012 |

OTHER PUBLICATIONS

May 31, 2018, Office Action issued by the State Intellectual Property Office in the corresponding Chinese Patent Application No. 201680013160.7 with English language Search Report.
May 31, 2016, International Search Report issued in the International Patent Application No. PCT/JP2016/001107.
Feb. 27, 2018, Extended European Search Report issued by the European Patent Office in the corresponding European Patent Application No. 16761275.3.

* cited by examiner

HIGH STRENGTH STEEL SHEET AND MANUFACTURING METHOD THEREFOR

TECHNICAL FIELD

The disclosure relates to a high strength steel sheet. The disclosure particularly relates to a high strength steel sheet having strength, blanking workability, and stretch flangeability and suitable for, for example, structural parts used in automotive suspension parts such as lower control arms, framework parts such as pillars and members and their reinforcing parts, door impact beams, seat members, vending machines, desks, household electrical appliances, office automation equipment, and building materials. The disclosure also relates to a manufacturing method for the high strength steel sheet.

BACKGROUND

Growing concerns about the global environment in recent years have increased the demand to reduce the usage of steel sheets with high $CO_2$ emissions in manufacture. In the automotive field, the need to improve fuel efficiency by lightening automotive bodies while maintaining the strength of automotive bodies has also been increasing. An effective way of lightening automotive bodies while maintaining their strength is to strengthen steel sheets as material for automotive parts to thus achieve sheet metal thinning.

Many automotive parts using steel sheets as material are formed by press working, flanging, and the like. Steel sheets for automotive parts are therefore required to have excellent blanking workability and stretch flangeability. Thus, workability as well as strength is critical for steel sheets for automotive parts, and high strength steel sheets excellent in workability such as stretch flangeability have been in demand.

Active research and development have been conducted to obtain high strength steel sheets having both strength and workability. However, since strengthening steel material typically leads to lower workability, it is difficult to impart workability such as blanking workability and stretch flangeability to high strength steel sheets without compromising strength.

For example, JP 2008-261029 A (PTL 1) discloses the following steel sheet with improved blanking workability. The steel sheet contains C: 0.010% to 0.200%, Si: 0.01% to 1.5%, Mn: 0.25% to 3%, P: 0.05% or less, and one or more selected from the group consisting of Ti, Nb, V, and Mo, and the amount of C segregated in large-angle crystal grain boundaries of ferrite is 4 atms/nm$^2$ to 10 atms/nm$^2$.

JP 2011-17060 A (PTL 2) discloses the following steel sheet with improved flange workability. The steel sheet contains C: 0.08% to 0.20%, Si: 0.2% to 1.0%, Mn: 0.5% to 2.5%, P: 0.04% or less, S: 0.005% or less, Al: 0.05% or less, Ti: 0.07% to 0.20%, and V: 0.20% to 0.80%, and has a ferrite phase of 80% to 98% and a secondary phase. The total content of Ti and V in a precipitate of less than 20 nm is 0.150% or more, and the difference in Vickers hardness between the ferrite phase and the secondary phase is −300 to 300.

JP 2011-12308 A (PTL 3) discloses the following steel sheet. The steel sheet has a chemical composition containing C: 0.03% to 0.07%, Si: 0.005% to 1.8%, Mn: 0.1% to 1.9%, P: 0.05% or less, S: 0.005% or less, Al: 0.001% to 0.1%, N: 0.005% or less, and Nb: 0.002% to 0.008% with the contents of Ti and S being limited, has proeutectoid ferrite of 90% or more, and has a mean crystal grain size of 5 μm to 12 μm and an elongation rate of 1.2 to 3. The mean particle size of TiC is 1.5 nm to 3 nm, and the density of TiC is $1\times10^{16}$ to $5\times10^{17}$ per cm$^3$.

JP 2011-225938 A (PTL 4) discloses the following steel sheet. The steel sheet has a microstructure made up of ferrite phase and bainite phase, where 40% or more of the ferrite phase has an interphase-precipitated structure with a spacing of 20 nm to 60 nm.

JP 2011-68945 A (PTL 5) discloses the following steel sheet. The steel sheet has a chemical composition containing C: 0.06% to 0.15%, Si: 1.2% or less, Mn: 0.5% to 1.6%, P: 0.04% or less, S: 0.05% or less, Al: 0.05% or less, and Ti: 0.05% to 0.16%, has a ferrite phase of 50% to 90%, and has a total of a ferrite phase and a bainite phase of 95% or more. A Ti-containing precipitate of less than 20 nm in the ferrite phase is 650 ppm to 1100 ppm, and the variation of the Vickers hardness of the bainite phase is 150 or less.

CITATION LIST

Patent Literatures

PTL 1: JP 2008-261029 A
PTL 2: JP 2011-17060 A
PTL 3: JP 2011-12308 A
PTL 4: JP 2011-225938 A
PTL 5: JP 2011-68945 A

SUMMARY

Technical Problem

With the technique described in PTL 1, however, after finish hot rolling, the steel sheet needs to be cooled to a narrow temperature range of 600° C. to 650° C. at a high cooling rate of 50° C./s or more. Thus, stably manufacturing the steel sheet described in PTL 1 is difficult, and also the manufacture of the steel sheet requires high facility investment.

The steel sheets described in PTL 2 to PTL 5 have stretch flangeability or burring workability improved to some extent, but have insufficient blanking workability.

It could be helpful to provide a high strength hot rolled steel sheet having high strength such as a tensile strength (TS) of 780 MPa or more and having excellent blanking workability and stretch flangeability, and a manufacturing method for the high strength hot rolled steel sheet.

Solution to Problem

We studied to achieve both high strength and excellent blanking workability and stretch flangeability, and discovered the following.

By using a ferrite microstructure with high ductility as a main phase and forming a fine precipitate with a particle size of 20 nm or less in steel, high strength can be achieved without significantly lowering formability. Moreover, by precipitating Fe as cementite, the cementite serves as a crack origin in blanking, and the fine precipitate with a particle size of 20 nm or less facilitates crack propagation to suppress end surface cracking in blanking. This greatly improves blanking workability. Furthermore, in stretch flanging, the fine precipitate suppresses stress concentration on the cementite to distribute stress, so that stretch flangeability is greatly improved, too.

The disclosure is based on the aforementioned discoveries. We thus provide:

1. A high strength steel sheet comprising: a chemical composition containing (consisting of), in mass %, C: 0.05% to 0.30%, Si: 0.6% to 2.0%, Mn: 1.3% to 3.0%, P: 0.10% or less, S: 0.030% or less, Al: 2.0% or less, N: 0.010% or less, and one or more of Ti, Nb, and V: 0.01% to 1.0% each, with a balance being Fe and incidental impurities; a ferrite microstructure of 50% or more in area ratio; and a precipitate with a particle size of less than 20 nm, wherein Fe is precipitated in an amount of 0.04 mass % or more and C* defined by the following Expression (1) and $C^*_p$ defined by the following Expression (2) meet conditions of the following Expressions (3) to (5):

$$C^*=([Ti]/48+[Nb]/93+[V]/51+[Mo]/96+[Ta]/181+[W]/184)\times 12 \quad (1)$$

$$C^*_p=([Ti]_p/48+[Nb]_p/93+[V]_p/51+[Mo]_p/96+[Ta]_p/181+[W]_p/184)\times 12 \quad (2)$$

$$C^*\geq 0.035 \quad (3)$$

$$-0.015\leq [C]-C^*\leq 0.03 \quad (4)$$

$$C^*_p/C^*\geq 0.3 \quad (5)$$

where [M] denotes a content of an element M in the high strength steel sheet in mass %, and $[M]_p$ denotes a content, with respect to the whole high strength steel sheet, of the element M contained in the precipitate with the particle size of less than 20 nm in mass %, [M] and $[M]_p$ being 0 in the case where the element M is not contained in the high strength steel sheet.

2. The high strength steel sheet according to 1., wherein the chemical composition further contains, in mass %, one or more of Mo, Ta, and W: 0.005% to 0.50% each.

3. The high strength steel sheet according to 1. or 2., wherein the chemical composition further contains, in mass %, one or more of Cr, Ni, and Cu: 0.01% to 1.0% each.

4. The high strength steel sheet according to any one of 1. to 3., wherein the chemical composition further contains, in mass %, Sb: 0.005% to 0.050%.

5. The high strength steel sheet according to any one of 1. to 4., wherein the chemical composition further contains, in mass %, one or both of Ca and REM: 0.0005% to 0.01% each.

6. A manufacturing method for the high strength steel sheet according to any one of 1. to 5., the manufacturing method comprising: a hot rolling step of performing rough rolling and finish rolling on a steel raw material having the chemical composition according to any one of 1. to 5., to obtain a steel sheet; a first rapid cooling step of cooling the steel sheet after the finish rolling, at an average cooling rate of 30° C./s or more from completion of the finish rolling to start of a subsequent intermediate slow cooling step; the intermediate slow cooling step of slow cooling the steel sheet after the first rapid cooling step, from a start temperature of more than 650° C. and 750° C. or less for 1 s to 10 s at an average cooling rate of less than 10° C./s; a second rapid cooling step of cooling the steel sheet after the intermediate slow cooling step, at an average cooling rate of 10° C./s or more from completion of the intermediate slow cooling step to start of a subsequent coiling step; and the coiling step of coiling the steel sheet after the second rapid cooling step, at a coiling temperature of 350° C. to 500° C., wherein the finish rolling is performed under the following conditions: a finisher entry temperature of the steel sheet: 900° C. to 1100° C., a total rolling reduction in the finish rolling: 88% or more, a finisher delivery temperature of the steel sheet: 800° C. to 950° C., and a finisher delivery sheet passing rate: 300 m/min or more.

7. The manufacturing method according to 6., further comprising a working step of working the steel sheet after the coiling step, at a thickness reduction of 0.1% to 3.0%.

Advantageous Effect

It is thus possible to obtain a high strength hot rolled steel sheet having high strength such as a tensile strength (TS) of 780 MPa or more and having excellent blanking workability and stretch flangeability.

DETAILED DESCRIPTION

Figure 1:
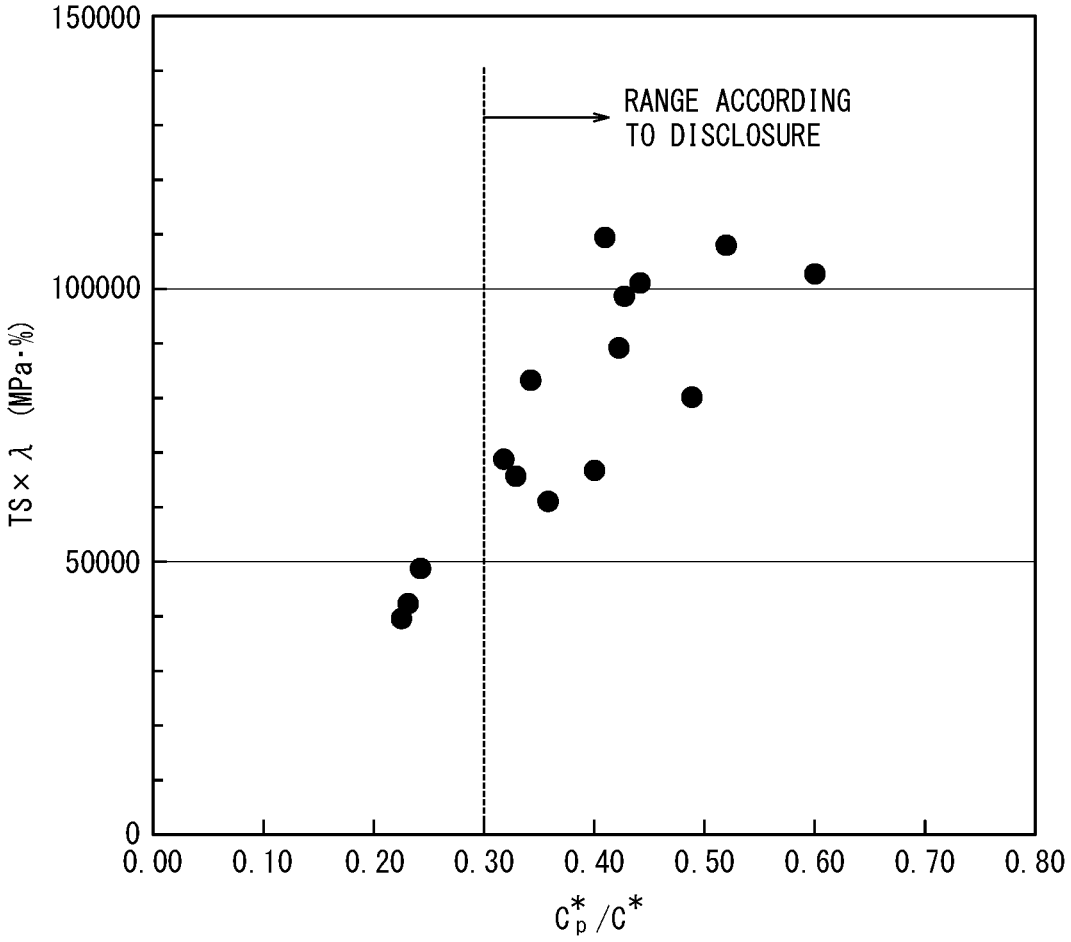
FIG. 1 is a diagram illustrating the influence of $C^*_p/C^*$ on TS×λ.

Detailed description is given below.

In the disclosure, it is important that a high strength steel sheet has the chemical composition stated above. The reasons for limiting the chemical composition of the steel material as stated above are given first. In the description of the chemical composition, "%" denotes "mass %" unless otherwise noted.

C: 0.05% to 0.30%

C is an element that acts to enhance the strength of the steel by forming a fine carbide with Ti, Nb, or V. C also forms cementite with Fe, and contributes to higher blanking workability. To achieve these effects, the C content needs to be 0.05% or more. If the C content is high, ferrite transformation is inhibited, and as a result the formation of a fine carbide of Ti, Nb, or V decreases. Besides, excessive C causes the formation of a large amount of cementite, which significantly lowers stretch flangeability. The C content therefore needs to be 0.30% or less. The C content is preferably 0.25% or less, and more preferably 0.20% or less.

Si: 0.6% to 2.0%

Si promotes ferrite transformation in an intermediate slow cooling process after hot rolling, and facilitates the formation of a fine carbide from Ti, Nb, or V precipitated simultaneously with the transformation. Si also has a function as a solid-solution-strengthening element that strengthens the steel without significantly lowering formability. To achieve these effects, the Si content needs to be 0.6% or more. The Si content is preferably 1.0% or more, and further preferably 1.2% or more. If the Si content is high, ferrite transformation in a rapid cooling process (first cooling step) before intermediate slow cooling is promoted, and as a result a coarse carbide of Ti, Nb, or V precipitates. Besides, Si oxide tends to form on the surface. This is likely to cause failures such as poor chemical conversion treatment in a hot rolled steel sheet and non-coating in a coated steel sheet. The Si content therefore needs to be 2.0% or less. The Si content is preferably 1.5% or less.

Mn: 1.3% to 3.0%

Mn acts to prevent ferrite transformation from starting before intermediate slow cooling, in cooling after hot rolling. Mn also contributes to higher strength of the steel by solid solution strengthening. Mn further acts to render harmful S in the steel, harmless as MnS. To achieve these effects, the Mn content needs to be 1.3% or more. The Mn content is preferably 1.5% or more. If the Mn content is high, ferrite transformation is inhibited, and the formation of a fine carbide of Ti, Nb, or V is inhibited. The Mn content therefore needs to be 3.0% or less. The Mn content is preferably 2.5% or less, and further preferably 2.0% or less.

P: 0.10% or Less

P segregates to grain boundaries, and causes a decrease in ductility and toughness of the steel. Besides, if the P content is high, ferrite transformation in the rapid cooling process (first rapid cooling step) after rolling and before intermediate slow cooling is promoted, and as a result a coarse carbide of Ti, Nb, or V precipitates. The P content therefore needs to be 0.10% or less. The P content is preferably 0.05% or less, more preferably 0.03% or less, and further preferably 0.01% or less. No lower limit is placed on the P content. The lower limit may be 0%, yet in industrial terms the lower limit is more than 0%. Excessively low P content leads to longer refining time and higher cost, and so the P content is preferably 0.0005% or more.

S: 0.030% or Less

S greatly decreases hot ductility, and thus induces hot cracking and significantly degrades surface characteristics. Besides, S not only hardly contributes to higher strength, but also forms a coarse sulfide and causes a decrease in ductility and stretch flangeability of the steel. Hence, the S content is desirably as low as possible. These problems are particularly noticeable when the S content is more than 0.030%. The S content is therefore 0.030% or less. The S content is preferably 0.010% or less, more preferably 0.003% or less, and further preferably 0.001% or less. No lower limit is placed on the S content. The lower limit may be 0%, yet in industrial terms the lower limit is more than 0%. Excessively low S content leads to longer refining time and higher cost, and so the S content is preferably 0.0005% or more.

Al: 2.0% or Less

If the Al content is high, ferrite transformation in the rapid cooling process (first rapid cooling step) after rolling and before intermediate slow cooling is promoted, and as a result a coarse carbide of Ti, Nb, or V precipitates. Besides, Al oxide tends to form on the surface of the steel sheet. This is likely to cause failures such as surface defects in a hot rolled steel sheet and non-coating or poor chemical conversion treatment in a coated steel sheet. The Al content therefore needs to be 2.0% or less. The Al content is preferably 1.5% or less, and further preferably 1.0% or less. No lower limit is placed on the Al content, yet the steel may be Al killed steel containing 0.01% or more Al as a deoxidizer. Al acts to promote ferrite transformation in the intermediate slow cooling process after rolling, and facilitates the formation of a fine carbide of Ti, Nb, or V. To achieve these effects, the Al content is preferably 0.2% or more, and more preferably 0.5% or more.

N: 0.010% or Less

N forms a coarse nitride with Ti, Nb, or V at high temperature, and does not much contribute to higher strength. Thus, N reduces the effect of strengthening by the addition of Ti, Nb, or V. Moreover, if the N content is high, the slab may crack during hot rolling and develop surface defects. The N content therefore needs to be 0.010% or less. The N content is preferably 0.005% or less, more preferably 0.003% or less, and further preferably 0.002% or less. No lower limit is placed on the N content. The lower limit may be 0%, yet in industrial terms the lower limit is more than 0%. Excessively low N content leads to longer refining time and higher cost, and so the N content is preferably 0.0005% or more.

One or More of Ti, Nb, and V: 0.01% to 1.0% Each

Ti, Nb, and V each form a fine carbide with C, to contribute to higher strength and also improve blanking workability and stretch flangeability. To achieve these effects, the content of each of the one or more of Ti, Nb, and V needs to be 0.01% or more. If the content of each of the one or more of Ti, Nb, and V is more than 1.0%, the strengthening effect is not particularly high, and higher manufacturing cost is required. The content of each of the one or more of Ti, Nb, and V therefore needs to be 1.0% or less.

Further, the following components may be optionally added to the steel, to improve the properties such as strength, blanking workability, and stretch flangeability.

One or More of Mo, Ta, and W: 0.005% to 0.50% Each

Mo, Ta, and W each form a fine precipitate and thus contribute to higher strength, blanking workability, and stretch flangeability. To achieve these effects, in the case of adding one or more of Mo, Ta, and W, the content of each of the one or more of Mo, Ta, and W is preferably 0.005% or more. If Mo, Ta, or W is added in a large amount, the effects saturate, and higher cost is required. Accordingly, in the case of adding one or more of Mo, Ta, and W, the content of each of the one or more of Mo, Ta, and W is preferably 0.50% or less.

One or More of Cr, Ni, and Cu: 0.01% to 1.0% Each

Cr, Ni, and Cu each refine the microstructure of the steel to contribute to higher strength and toughness. To achieve these effects, in the case of adding one or more of Cr, Ni, and Cu, the content of each of the one or more of Cr, Ni, and Cu is preferably 0.01% or more. If Cr, Ni, or Cu is added in a large amount, the effects saturate, and higher cost is required. Accordingly, in the case of adding one or more of Cr, Ni, and Cu, the content of each of the one or more of Cr, Ni, and Cu is preferably 1.0% or less.

Sb: 0.005% to 0.050%

Sb segregates to the steel surface during hot rolling to prevent the steel from nitriding. Adding Sb thus suppresses the formation of a coarse nitride. To achieve these effects, in the case of adding Sb, the Sb content is preferably 0.005% or more. Adding a large amount of Sb leads to higher cost. Accordingly, in the case of adding Sb, the Sb content is preferably 0.050% or less.

One or Both of Ca and REM: 0.0005% to 0.01% Each

Ca and REM (rare-earth metal) each control the sulfide form to improve ductility and stretch flangeability. To achieve these effects, in the case of adding one or both of Ca and REM, the content of each of the one or both of Ca and REM is preferably 0.0005% or more. If Ca or REM is added in a large amount, the effects saturate, and higher cost is required. Accordingly, in the case of adding one or both of Ca and REM, the content of each of the one or both of Ca and REM is preferably 0.01% or less.

The high strength steel sheet has balance that is Fe and incidental impurities. The high strength steel sheet may contain impurities and other trace elements, without compromising the functions and effects according to the disclosure. For example, a total content of 0.5% or less of impurities such as Sn, Mg, Co, As, Pb, Zn, and O is allowable as the properties of the steel sheet are unaffected.

In the disclosure, it is also important that the high strength steel sheet has a ferrite microstructure of 50% or more in area ratio, and Fe is precipitated in an amount of 0.04 mass % or more. The reasons for limiting the microstructure in this way are given below.

Ferrite Microstructure: 50% or More in Area Ratio

Ferrite is excellent in workability. To improve the workability of the steel sheet, the ratio of the ferrite microstructure to the metallic microstructure of the steel sheet is 50% or more in area ratio. The ferrite area ratio is preferably 60% or more, and more preferably 70% or more. No upper limit is placed on the ferrite area ratio, yet the upper limit is preferably 100%.

The microstructures of the balance other than ferrite are not limited, and may be any microstructures such as bainite, martensite, and pearlite. Upper bainite microstructure is preferable in terms of toughness. In the case of including upper bainite microstructure, its area ratio is preferably 5% or more, and more preferably 10% or more. No upper limit is placed on the area ratio of the upper bainite microstructure. The area ratio of the upper bainite microstructure may be less than 50%, and is preferably less than 40% and more preferably less than 30%.

Amount of Precipitated Fe: 0.04 Mass % or More

Fe, having formed a carbide, precipitates in the steel as cementite. If the amount of precipitated Fe is small, blanking workability decreases significantly. The amount of precipitated Fe is therefore 0.04 mass % or more. Excessive precipitation of Fe causes lower stretch flangeability. The amount of precipitated Fe is therefore preferably 0.5 mass % or less, more preferably 0.3 mass % or less, and further preferably 0.2 mass % or less. The amount of precipitated Fe mentioned here is the mass ratio of precipitated Fe to the whole steel sheet.

In the disclosure, it is also important that the high strength steel sheet contains a precipitate with a particle size of less than 20 nm, and C* defined by the foregoing Expression (1) and $C^*_p$ defined by the foregoing Expression (2) meet the conditions of the foregoing Expressions (3) to (5). The reasons for these limitations are given below.

Regarding Expressions (1), (3), and (4)

The value of C* defined by Expression (1) is the result of converting the total content of Ti, Nb, V, Mo, Ta, and W in the steel into carbon content on the assumption that these elements all form carbides. Ti, Nb, V, Mo, Ta, and W (hereafter also referred to as "Ti, etc.") each act to form a carbide to improve the strength of the steel. Hence, to improve the strength of the steel, these elements are added so that C* is 0.035 or more as defined by Expression (3). No upper limit is placed on C*, yet C* is preferably 0.2% or less and more preferably 0.15% or less in terms of preventing a decrease in workability caused by an increased amount of precipitated carbides.

Even when the additive amount of the elements Ti, etc. meets the condition of Expression (3), the amount of precipitated carbides decreases if the C content is low relative to the additive amount of Ti, etc. Ti, etc. that have not precipitated form a solute in the steel. Such solute Ti, etc. do not contribute to higher strength of the steel. Besides, since C is consumed to form carbides with the elements Ti, etc., if the C content is low, the amount of C for forming cementite decreases. This causes a decrease in the amount of precipitated cementite. Accordingly, the value of ([C]−C*) needs to be −0.015 or more, as defined by Expression (4). ([C]−C*) is preferably 0 or more, that is, [C] is preferably C* or more. If the C content is excessively high relative to the additive amount of Ti, etc., excess C not forming carbides with the elements Ti, etc. increases. A large amount of excess C increases the amount of precipitated cementite, which significantly lowers stretch flangeability. The value of the C content ([C]−C*) in the steel therefore needs to be 0.03 or less, as defined by Expression (4). ([C]−C*) is preferably 0.02 or less.

Regarding Expressions (2) and (5)

The elements Ti, etc. precipitate as carbides as mentioned above, but any precipitate with a particle size of 20 nm or more does not contribute to higher strength of the steel sheet. The steel sheet therefore needs to contain a precipitate with a particle size of less than 20 nm. Here, if the ratio of Ti, etc. forming a precipitate with a particle size of less than 20 nm is low relative to the additive amount of Ti, Nb, V, Mo, Ta, and W in the steel, strengthening efficiency is poor and higher manufacturing cost is required, and sufficient blanking workability and stretch flangeability cannot be achieved. Accordingly, the ratio ($C^*_p/C^*$) of the value of $C^*_p$ defined by Expression (2) to the value of C* defined by Expression (1) is 0.3 or more, as defined by Expression (5). The value of $C^*_p$ is the result of converting the total content of Ti, Nb, V, Mo, Ta, and W contained in any precipitate with a particle size of less than 20 nm, from among Ti, Nb, V, Mo, Ta, and W contained in the steel, into carbon content on the assumption that these elements all form carbides. In the case where Ti, Nb, V, Mo, Ta, and W contained in the steel all form precipitates with a particle size of less than 20 nm, $C^*_p/C^*$ is 1. $C^*_p/C^*$ is preferably 0.5 or more, more preferably 0.7 or more, and further preferably 0.9 or more. No upper limit is placed on $C^*_p/C^*$, yet $C^*_p/C^*$ is 1 at the maximum as mentioned above.

[Manufacturing Method]

A method of manufacturing the high strength steel sheet according to the disclosure is described below. The temperature mentioned in the following description denotes the surface temperature of the steel sheet unless otherwise noted.

The high strength steel sheet can be manufactured by hot rolling a steel raw material having the aforementioned chemical composition under specific conditions. In detail, the following steps (1) to (5) are performed in sequence:

(1) a hot rolling step of performing rough rolling and finish rolling on the steel raw material to obtain a steel sheet;

(2) a first rapid cooling step of cooling the steel sheet after the finish rolling;

(3) an intermediate slow cooling step of slow cooling the steel sheet after the first rapid cooling step;

(4) a second rapid cooling step of cooling the steel sheet after the intermediate slow cooling; and (5) a coiling step of coiling the steel sheet after the second rapid cooling step.

Furthermore, (6) a working step of working the steel sheet after the coiling step may be optionally performed.

Each of these steps (1) to (6) is described in detail below. Manufacturing steps other than those described below are not limited, and may be performed according to typical steel sheet manufacturing methods.

(1) Hot Rolling Step

A steel raw material having the aforementioned chemical composition is prepared first. The steel raw material can be obtained by steelmaking according to a conventional method and casting. The casting is preferably continuous casting in terms of productivity. The steel raw material (slab) is then hot rolled. The steel raw material may be directly hot rolled after the casting. Alternatively, the steel raw material as a warm slab or a cold slab may be reheated and then hot rolled. The hot rolling step can be performed in two stages, namely, rough rolling and finish rolling. The rough rolling conditions are not limited. Rough rolling may be omitted particularly in the case of using thin slab casting. The finish rolling conditions are as follows.

Finisher Entry Temperature: 900° C. to 1100° C.

If the finisher entry temperature of the steel sheet is low, strain is accumulated in the finisher in a state where coarse austenite grains generated in the rougher remain. Consequently, ferrite grains after transformation have a small orientation difference and a large grain size, which causes lower toughness and blanking workability. The finisher entry temperature of the steel sheet therefore needs to be 900° C. or more. The finisher entry temperature is preferably 950° C. or more. If the finisher entry temperature of the steel sheet is excessively high, the recrystallization of austenite progresses and strain accumulation decreases. This results in a large ferrite grain size after transformation, and causes lower toughness and blanking workability. The finisher entry temperature of the steel sheet therefore needs to be 1100° C. or less. The finisher entry temperature is preferably 1050° C. or less.

Total Rolling Reduction in Finish Rolling: 88% or More

If the total rolling reduction in the finish rolling is low, strain accumulation in the austenite region decreases. This results in a large ferrite grain size after transformation, and causes lower toughness and blanking workability. The total rolling reduction in the finish rolling therefore needs to be 88% or more. The total rolling reduction is preferably 90% or more, more preferably 92% or more, and further preferably 94% or more. No upper limit is placed on the total rolling reduction in the finish rolling, yet the total rolling reduction is preferably 96% or less. If the rolling reduction is excessively high, the rolling load increases, which makes the rolling difficult. The total rolling reduction in the finish rolling is defined here as $(t1-t2)/t1$, using the ratio of the sheet thickness $t2$ after the completion of the finish rolling to the sheet thickness $t1$ immediately before the start of the finish rolling.

Finisher Delivery Temperature: 800° C. to 950° C.

If the finisher delivery temperature of the steel sheet is low, ferrite transformation in the cooling process (first rapid cooling step) from the completion of the finish rolling to the intermediate slow cooling is promoted, as a result of which a coarse carbide of Ti, Nb, or V precipitates. If the finisher delivery temperature is in the ferrite region, the carbide of Ti, Nb, or V becomes coarser due to strain-induced precipitation. The finisher delivery temperature of the steel sheet therefore needs to be 800° C. or more. The finisher delivery temperature is preferably 850° C. or more. If the finisher delivery temperature of the steel sheet is excessively high, strain accumulation in the austenite region decreases. This results in a large ferrite grain size after transformation, and causes lower toughness and blanking workability. The finisher delivery temperature therefore needs to be 950° C. or less. The finisher delivery temperature is preferably 900° C. or less.

Finisher Delivery Sheet Passing Rate: 300 m/Min or More

If the finisher delivery sheet passing rate is low, strain accumulation in the austenite region decreases. This promotes the formation of coarse ferrite in part after transformation. The finisher delivery sheet passing rate therefore needs to be 300 m/min or more. The finisher delivery sheet passing rate is preferably 400 m/min or more. No upper limit is placed on the sheet passing rate, yet the sheet passing rate is preferably 1000 m/min or less for stable sheet passing.

(2) First Rapid Cooling Step

Average Cooling Rate from the Completion of Finish Rolling to the Start of Intermediate Slow Cooling: 30° C./s or More The first rapid cooling step of cooling the steel sheet after the finish rolling is then performed. In the first rapid cooling step, the average cooling rate from the completion of the finish rolling to the start of the intermediate slow cooling is 30° C./s or more. If the cooling rate from the completion of the finish rolling to the start of the intermediate slow cooling is low, ferrite transformation is promoted, and a coarse carbide of Ti, Nb, or V precipitates. The average cooling rate therefore needs to be 30° C./s or more. The average cooling rate is preferably 50° C./s or more, and further preferably 80° C./s or more. No upper limit is placed on the average cooling rate, yet the average cooling rate is preferably 200° C./s or less in terms of temperature control.

(3) Intermediate Slow Cooling Step

Intermediate Slow Cooling Start Temperature: More than 650° C. and 750° C. or Less When the temperature of the steel sheet reaches a predetermined temperature, the rapid cooling ends, and the intermediate slow cooling starts. If the intermediate slow cooling start temperature is excessively high, ferrite transformation occurs at high temperature, as a result of which a coarse carbide of Ti, Nb, or V precipitates. The intermediate slow cooling start temperature therefore needs to be 750° C. or less. If the intermediate slow cooling start temperature is excessively low, the precipitation of the carbide of Ti, Nb, or V is insufficient. The intermediate slow cooling start temperature therefore needs to be more than 650° C.

Average Cooling Rate During Intermediate Slow Cooling: Less than 10° C./s

If the cooling rate during the intermediate slow cooling is high, ferrite transformation is insufficient, and the amount of precipitated fine carbide of Ti, Nb, or V is small. The average cooling rate during the intermediate slow cooling therefore needs to be less than 10° C./s. The average cooling rate is preferably less than 6° C./s. No lower limit is placed on the average cooling rate, yet the average cooling rate is preferably 4° C./s or more.

Intermediate Slow Cooling Time: 1 s to 10 s

If the intermediate slow cooling time is excessively short, ferrite transformation is insufficient, and the amount of precipitated fine carbide of Ti, Nb, or V is small. The intermediate slow cooling time therefore needs to be 1 s or more. The intermediate slow cooling time is preferably 2 s or more, and more preferably 3 s or more. If the intermediate slow cooling time is excessively long, the carbide of Ti, Nb, or V coarsens. The intermediate slow cooling time therefore needs to be 10 s or less. The intermediate slow cooling time is preferably 6 s or less.

(4) Second Rapid Cooling Step

Average Cooling Rate from the Completion of Intermediate Slow Cooling to the Start of Coiling: 10° C./s or More After the intermediate slow cooling, the second rapid cooling step is performed. In the second rapid cooling step, the average cooling rate from the completion of the intermediate slow cooling to the start of the subsequent coiling is 10° C./s or more. If the cooling rate from the completion of the intermediate slow cooling to the start of the coiling is excessively low, the carbide of Ti, Nb, or V coarsens. The average cooling rate from the completion of the intermediate slow cooling to the start of the coiling therefore needs to be 10° C./s or more. The average cooling rate is preferably 30° C./s or more, and more preferably 50° C./s or more. No upper limit is placed on the average cooling rate, yet the average cooling rate is preferably 100° C./s or less in terms of temperature control.

(5) Coiling Step

Coiling Temperature: 350° C. to 500° C.

Subsequently, the steel sheet after the second rapid cooling step is coiled. The coiling temperature is 350° C. to 500° C. If the coiling temperature is excessively high, the carbide of Ti, Nb, or V coarsens. The coiling temperature therefore needs to be 500° C. or less. If the coiling temperature is excessively low, the formation of cementite which is Fe carbide is inhibited. The coiling temperature therefore needs to be 350° C. or more.

(6) Working Step

Light working may be performed on the steel sheet after the coiling step, to increase mobile dislocations and enhance the blanking workability of the steel sheet. To achieve this, the working is preferably performed with a thickness reduction of 0.1% or more. The thickness reduction is more preferably 0.3% or more. If the thickness reduction is excessively high, dislocations are less mobile due to their interactions, which causes lower blanking workability. Accordingly, in the case of working the steel sheet, the thickness reduction is preferably 3.0% or less, more preferably 2.0% or less, and further preferably 1.0% or less. The working method may be reduction rolling using rolls, tensile working of applying tension by pulling the steel sheet, or a combination of rolling and tension application.

The high strength steel sheet includes a high strength steel sheet that is surface-treated, coated, and the like. For example, the hot rolled steel sheet manufactured according to the procedure described above is pickled to remove scale formed on the surface, and then coated on the surface. The coating may be any of various coatings, for example, zinc coating, zinc alloy coating such as composite coating of zinc and Al or composite coating of zinc and Ni, Al coating, and Al alloy coating such as composite coating of Al and Si. The coating method may be any of hot dip coating and electroplating. Alloying treatment may be performed by heating after the coating. A hot-dip zinc or zinc alloy coated steel sheet or a galvannealed steel sheet is preferable. After the coating, chemical conversion treatment or painting may be applied to coat the coating.

The tensile strength (TS) of the high strength steel sheet is preferably 780 MPa or more. The hole expansion ratio of the high strength steel sheet is preferably 55% or more. The upper limit of the hole expansion ratio is preferably about 150%. The product (TS×λ) of the tensile strength and the hole expansion ratio is preferably 60000 MPa·% or more, and preferably 150000 MPa·% or less. The blanking workability of the high strength steel sheet is preferably such a degree that has no cracking in the end surface in the below-mentioned blanking test. The sheet thickness of the high strength steel sheet is preferably 2.0 mm to 4.0 mm.

Examples

More detailed description is given below, based on examples. The following examples merely represent preferred examples, and the disclosure is not limited to these examples.

After heating each of the slabs having the chemical compositions listed in Table 1, the slab was hot rolled under the conditions listed in Table 2, to yield a hot rolled steel sheet. Some of the steel sheets were worked with the thickness reductions listed in Table 2. A test piece was collected from each of the obtained hot rolled steel sheets, and the microstructure and mechanical properties were evaluated by the following methods. Table 3 lists the evaluation results of each item.

[Ferrite Area Ratio]

The ferrite area ratio was evaluated according to the following procedure. First, a cross section of the steel sheet taken in the sheet thickness direction to be parallel to the rolling direction was etched with natal to expose microstructure, thus obtaining a sample. The microstructure of a 300×300 $\mu m^2$ region of the surface of the sample was then observed using a scanning electron microscope (SEM) at 500 magnifications, to calculate the area ratio of the ferrite microstructure.

[Amount of Precipitated Fe]

The amount of precipitated Fe was determined by electrolytic extraction. In detail, constant-current electrolysis was performed using the test piece as the anode, to dissolve a predetermined amount of the test piece. The electrolysis was performed in a 10% AA-based electrolytic solution, i.e. a 10 vol % acetylacetone-1 mass % tetramethylammonium chloride-methanol solution. The residue extracted by the electrolysis was then filtered using a filter with a pore size of 0.2 μm, to collect a precipitate. The obtained precipitate was dissolved using mixed acid, and then Fe was quantitatively determined by ICP optical emission spectrometry. The amount of precipitated Fe was calculated from the obtained measurement.

[$C^*_p$]

The value of $C^*_p$ defined by Expression (2) was calculated as follows. First, constant-current electrolysis was performed in a 10% AA-based electrolytic solution using the test piece as the anode, to dissolve a predetermined amount of the test piece. The electrolytic solution was then filtered using a filter with a pore size of 20 nm. The resulting filtrate was analyzed by ICP optical emission spectrometry, to measure each of the amounts of Ti, Nb, V, Mo, Ta, and W. The value of $C^*_p$ was calculated from the obtained measurement.

[Tensile Test (YS, TS, El)]

A JIS No. 5 tensile test piece was cut out from each of the obtained hot rolled steel sheets so that the longitudinal direction of the test piece was orthogonal to the rolling direction, and the mechanical properties of the test piece were evaluated according to the method of tensile testing for metallic materials defined in JIS-Z2241. The measurement items include yield strength (YS), tensile strength (TS), and total elongation (El).

[Hole Expansion Ratio (λ)]

The stretch flangeability of each steel sheet was evaluated based on the hole expansion ratio (λ). The hole expansion ratio (λ) was measured by cutting out a test piece from each hot rolled steel sheet and conducting a hole expanding test according to JIS-Z2256.

[Blanking Workability]

The blanking workability of each steel sheet was evaluated by the following method. The steel sheet was blanked with a hole of 10 mm in diameter with clearance being increased by 5% in a range of 5% to 30%. The blanking were performed tree times for each clearance. A sample whose end surface state was worst was visually observed using a magnifier (10 magnifications). The evaluation was made in three levels: end surface cracking (poor), microcracking (unsatisfactory), and no cracking (satisfactory).

As indicated in Table 3, all steel sheets (Examples) meeting the conditions according to the disclosure had a high tensile strength (TS) of 780 MPa or more and excellent stretch flangeability (hole expansion ratio) and blanking workability. The steel sheets (Comparative Examples) not meeting the conditions according to the disclosure were insufficient in one or more of tensile strength, stretch flangeability, and blanking workability.

Figure 2:
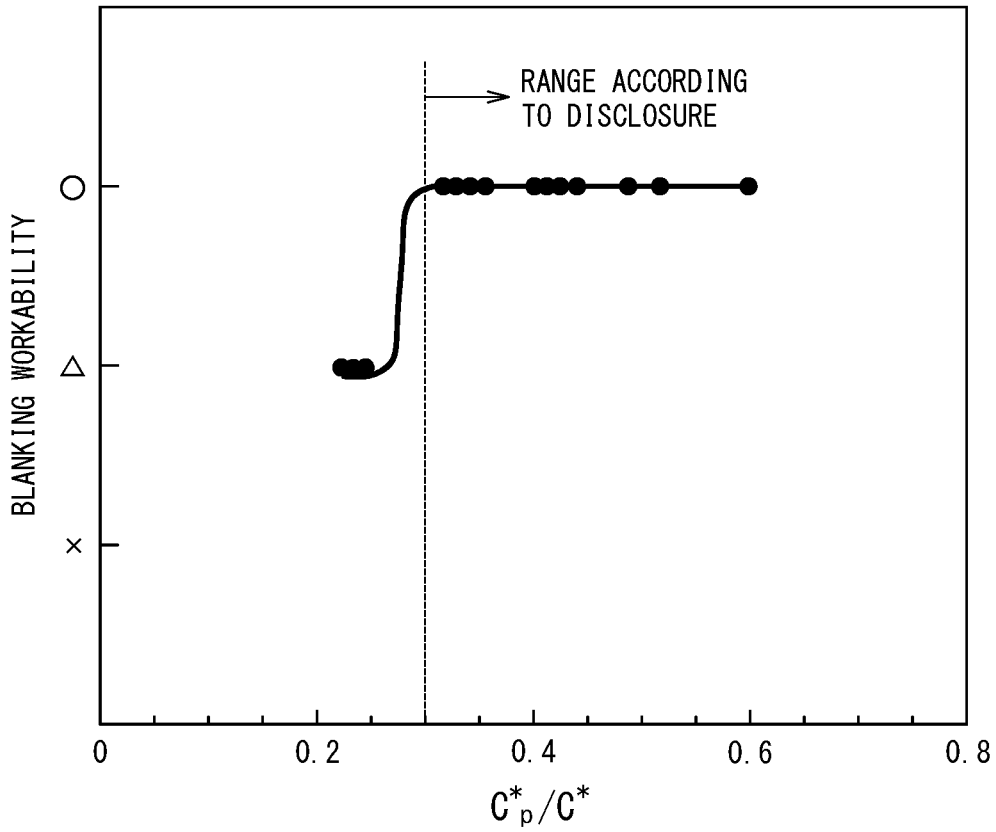
FIG. 2 is a diagram illustrating the influence of $C^*_p/C^*$ on blanking workability.

FIG. 1 illustrates the correlation between the $C^*_p/C^*$ value and the product (TS×λ) of the tensile strength and the hole expansion ratio in each of the steel sheets No. 1 to 7, 10 to 18, 20, and 21. Likewise, FIG. 2 illustrates the correlation between the $C^*_p/C^*$ value and the blanking workability in each of the steel sheets. It can be understood from FIGS. 1 and 2 that TS×λ of 60000 MPa·% or more and satisfactory blanking workability can be achieved when the $C^*_p/C^*$ value is 0.3 or more.

Figure 3:
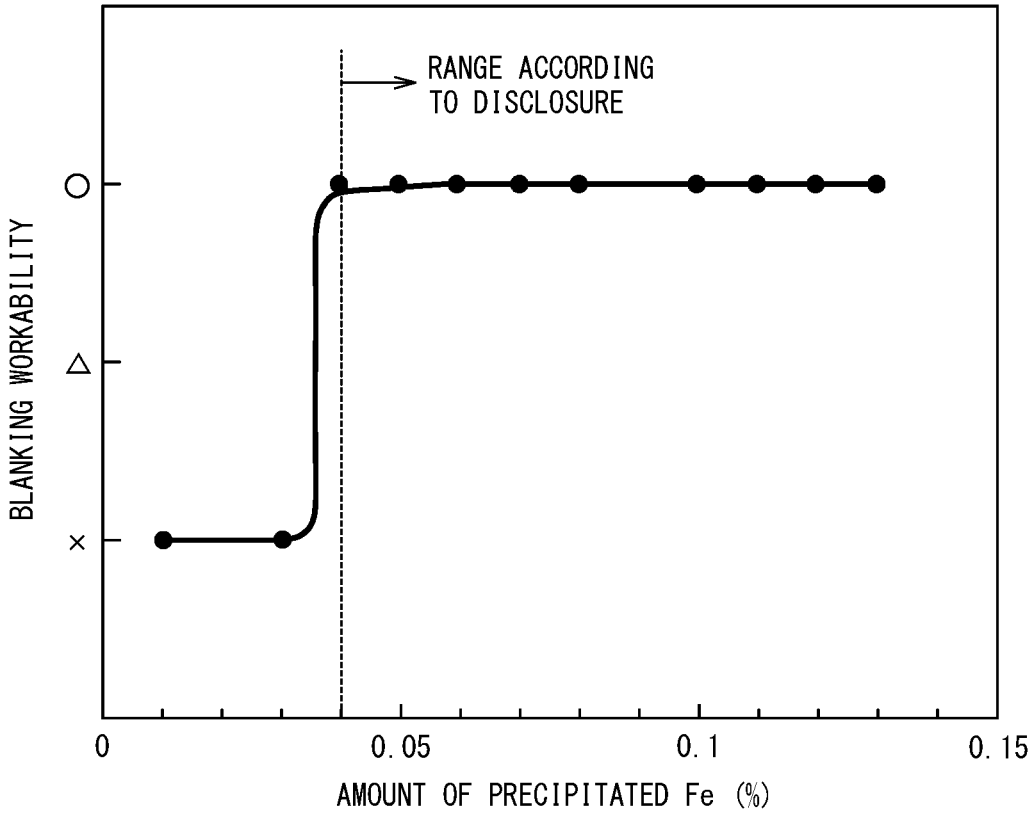
FIG. 3 is a diagram illustrating the influence of the amount of precipitated Fe on blanking workability.

FIG. 3 illustrates the correlation between the amount of precipitated Fe and the blanking workability in each of the steel sheets No. 1 to 8, 10, 11, 14 to 16, 18, 19, and 22. It can be understood from FIG. 3 that satisfactory blanking workability can be achieved when the amount of precipitated Fe is 0.04% or more. In each of FIGS. 1 to 3, data of each steel sheet whose steel microstructure and chemical composition, except the value represented in the horizontal axis, do not meet the conditions according to the disclosure is excluded from the plot in order to eliminate any influence of the parameters other than the value of the horizontal axis.

TABLE 1

| Steel sample | Chemical composition (mass %) | | | | | | | | | | | | | | | [C] − | |
|---|---|---|---|---|---|---|---|---|---|---|---|---|---|---|---|---|---|
| ID | C | Si | Mn | P | S | Al | N | Ti | Nb | V | Mo | Ta | W | Others | C* | C* | Remarks |
| A | 0.05 | 1.5 | 2.3 | 0.03 | 0.019 | 1.20 | 0.005 | 0.08 | 0.02 | 0.06 | — | — | — | Cr: 0.10, Ni: 0.10, Cu, 0.20 | 0.037 | 0.013 | Conforming steel |
| B | 0.08 | 1.9 | 2.8 | 0.01 | 0.003 | 0.06 | 0.004 | 0.21 | — | — | — | — | — | Ca: 0.005, REM: 0.005 | 0.053 | 0.028 | Conforming steel |
| C | 0.06 | 1.1 | 1.5 | 0.01 | 0.003 | 0.05 | 0.003 | 0.16 | — | — | — | — | — | — | 0.040 | 0.020 | Conforming steel |
| D | 0.09 | 1.0 | 1.5 | 0.01 | 0.001 | 0.05 | 0.003 | 0.15 | — | 0.25 | — | — | — | — | 0.096 | −0.006 | Conforming steel |
| E | 0.05 | 1.0 | 1.5 | 0.01 | 0.001 | 0.04 | 0.003 | 0.20 | — | | — | — | — | — | 0.050 | 0.000 | Conforming steel |
| F | 0.17 | 1.1 | 1.6 | 0.01 | 0.001 | 0.04 | 0.005 | — | — | 0.75 | — | — | — | — | 0.176 | −0.006 | Conforming steel |
| G | 0.18 | 1.0 | 1.5 | 0.01 | 0.001 | 0.04 | 0.004 | 0.07 | — | 0.70 | — | — | — | — | 0.182 | −0.002 | Conforming steel |
| H | 0.05 | 1.0 | 1.4 | 0.01 | 0.001 | 0.05 | 0.003 | 0.28 | — | — | — | — | — | — | 0.070 | −0.020 | Comparative steel |
| I | 0.32 | 1.2 | 1.5 | 0.01 | 0.001 | 0.03 | 0.006 | 0.15 | 0.05 | 0.85 | 0.41 | — | — | | 0.295 | 0.025 | Comparative steel |
| J | 0.07 | 0.6 | 1.3 | 0.08 | 0.010 | 0.70 | 0.004 | 0.07 | 0.05 | 0.11 | — | — | — | — | 0.050 | 0.020 | Conforming steel |
| K | 0.10 | 1.1 | 1.6 | 0.01 | 0.001 | 0.04 | 0.004 | 0.12 | | 0.20 | 0.20 | — | — | | 0.102 | −0.002 | Conforming steel |
| L | 0.06 | 1.3 | 3.2 | 0.01 | 0.001 | 0.05 | 0.004 | 0.05 | 0.05 | 0.08 | — | — | — | — | 0.038 | 0.022 | Comparative steel |
| M | 0.05 | 2.2 | 1.6 | 0.02 | 0.002 | 0.06 | 0.005 | 0.10 | 0.05 | 0.05 | — | — | — | — | 0.043 | 0.007 | Comparative steel |
| N | 0.06 | 1.2 | 1.6 | 0.02 | 0.015 | 0.05 | 0.006 | 0.11 | 0.03 | 0.08 | 0.07 | 0.03 | 0.05 | Cr: 0.11, Ni: 0.12, Cu: 0.15, Sb: 0.008, Ca: 0.004, REM: 0.004 | 0.064 | −0.004 | Conforming steel |
| O | 0.07 | 1.2 | 1.6 | 0.06 | 0.025 | 1.80 | 0.008 | 0.12 | 0.03 | 0.15 | 0.05 | 0.02 | 0.11 | | 0.084 | −0.014 | Conforming steel |
| P | 0.06 | 2.0 | 1.8 | 0.02 | 0.002 | 0.20 | 0.002 | 0.15 | — | 0.09 | — | — | — | Sb: 0.01 | 0.059 | 0.001 | Conforming steel |
| Q | 0.05 | 0.7 | 1.6 | 0.01 | 0.001 | 0.02 | 0.006 | 0.19 | — | — | — | — | — | — | 0.048 | 0.003 | Conforming steel |
| R | 0.29 | 1.2 | 1.3 | 0.01 | 0.002 | 0.05 | 0.005 | 0.05 | 0.10 | 1.0 | — | — | — | Cr: 0.10 | 0.261 | 0.029 | Conforming steel |
| S | 0.06 | 0.8 | 1.5 | 0.02 | 0.001 | 0.05 | 0.005 | 0.11 | — | 0.11 | — | — | — | — | 0.053 | 0.007 | Conforming steel |
| T | 0.07 | 0.9 | 1.4 | 0.01 | 0.010 | 0.08 | 0.006 | 0.15 | — | 0.10 | — | — | — | — | 0.061 | 0.009 | Conforming steel |
| U | 0.06 | 1.2 | 1.5 | 0.03 | 0.001 | 0.06 | 0.004 | 0.14 | 0.05 | — | — | — | — | — | 0.041 | 0.019 | Conforming steel |
| V | 0.04 | 1.1 | 1.5 | 0.01 | 0.001 | 0.05 | 0.003 | 0.15 | — | 0.05 | — | — | — | — | 0.049 | −0.009 | Comparative steel |
| W | 0.08 | 0.9 | 1.6 | 0.02 | 0.002 | 0.06 | 0.002 | 0.16 | — | — | — | — | — | — | 0.040 | 0.040 | Comparative steel |

TABLE 2

| | | Finish rolling | | | | First rapid cooling | Intermediate slow cooling | | | Second rapid cooling | Coiling | | |
|---|---|---|---|---|---|---|---|---|---|---|---|---|---|
| No. | Steel sample ID | Entry temperature (° C.) | Total rolling reduction (%) | Delivery temperature (° C.) | Delivery sheet passing rate (m/min) | Average cooling rate (° C./s) | Start temperature (° C.) | Average cooling rate (° C./s) | Slow cooling time (s) | Average cooling rate (° C./s) | Coiling temperature (° C.) | Working Thickness reduction * (%) | Remarks |
| 1 | A | 980 | 91 | 810 | 450 | 65 | 680 | 4 | 4 | 45 | 420 | — | Example |
| 2 | B | 1010 | 90 | 830 | 350 | 75 | 710 | 3 | 8 | 35 | 380 | — | Example |
| 3 | C | 1020 | 91 | 780 | 410 | 85 | 720 | 4 | 4 | 35 | 380 | — | Comparative Example |
| 4 | D | 1010 | 90 | 880 | 390 | 60 | 720 | 3 | 4 | 35 | 430 | — | Example |
| 5 | E | 1000 | 91 | 870 | 400 | 50 | 730 | 4 | 3 | 30 | 450 | — | Example |
| 6 | F | 1020 | 90 | 880 | 430 | 65 | 700 | 5 | 4 | 35 | 450 | — | Example |
| 7 | G | 1000 | 92 | 860 | 410 | 55 | 710 | 5 | 4 | 40 | 460 | — | Example |
| 8 | H | 960 | 90 | 880 | 520 | 75 | 730 | 4 | 5 | 20 | 470 | 0.3 | Comparative Example |
| 9 | I | 1020 | 91 | 890 | 400 | 65 | 700 | 4 | 4 | 30 | 440 | — | Comparative Example |
| 10 | J | 980 | 88 | 900 | 320 | 30 | 740 | 5 | 1 | 15 | 480 | 0.1 | Example |
| 11 | K | 1030 | 90 | 860 | 450 | 65 | 700 | 4 | 3 | 35 | 430 | — | Example |
| 12 | L | 980 | 92 | 920 | 430 | 60 | 740 | 4 | 1 | 25 | 420 | — | Comparative Example |

TABLE 2-continued

| No. | Steel sample ID | Finish rolling: Entry temperature (° C.) | Finish rolling: Total rolling reduction (%) | Finish rolling: Delivery temperature (° C.) | Delivery sheet passing rate (m/min) | First rapid cooling: Average cooling rate (° C./s) | Intermediate slow cooling: Start temperature (° C.) | Intermediate slow cooling: Average cooling rate (° C./s) | Intermediate slow cooling: Slow cooling time (s) | Second rapid cooling: Average cooling rate (° C./s) | Coiling: Coiling temperature (° C.) | Working Thickness reduction * (%) | Remarks |
|---|---|---|---|---|---|---|---|---|---|---|---|---|---|
| 13 | M | 1020 | 91 | 870 | 450 | 80 | 700 | 4 | 2 | 40 | 460 | — | Comparative Example |
| 14 | N | 930 | 91 | 850 | 420 | 160 | 720 | 5 | 4 | 35 | 460 | 1.5 | Example |
| 15 | O | 1050 | 92 | 940 | 450 | 60 | 660 | 6 | 3 | 25 | 400 | — | Example |
| 16 | P | 1080 | 94 | 900 | 600 | 80 | 700 | 8 | 2 | 50 | 350 | 2.5 | Example |
| 17 | Q | 990 | 92 | 920 | 510 | 55 | 760 | 5 | 4 | 40 | 460 | — | Comparative Example |
| 18 | R | 950 | 91 | 880 | 420 | 60 | 720 | 4 | 3 | 45 | 430 | — | Example |
| 19 | S | 1020 | 90 | 870 | 420 | 60 | 710 | 4 | 3 | 45 | 340 | — | Comparative Example |
| 20 | T | 980 | 91 | 880 | 400 | 50 | 690 | 4 | 3 | 35 | 520 | — | Comparative Example |
| 21 | U | 950 | 91 | 910 | 480 | 60 | 640 | 4 | 4 | 25 | 450 | 1.1 | Comparative Example |
| 22 | V | 1010 | 90 | 890 | 400 | 50 | 720 | 5 | 3 | 35 | 450 | — | Comparative Example |
| 23 | W | 980 | 91 | 870 | 380 | 55 | 710 | 5 | 3 | 30 | 390 | — | Comparative Example |

* Thickness reduction in working step after coiling step

TABLE 3

| No. | Microstructure: Ferrite area ratio (%) | Microstructure: $C^*_p$ | Microstructure: $C^*_p/C^*$ | Microstructure: Amount of precipitated Fe (mass %) | Sheet thickness (mm) | Mechanical properties: Yield strength YS (MPa) | Mechanical properties: Tensile strength TS (MPa) | Mechanical properties: Total elongation El (%) | Mechanical properties: Hole expansion ratio λ (%) | Mechanical properties: TS × λ (MPa · %) | Mechanical properties: Blanking workability | Remarks |
|---|---|---|---|---|---|---|---|---|---|---|---|---|
| 1 | 60 | 0.015 | 0.41 | 0.05 | 2.6 | 670 | 780 | 21 | 140 | 109200 | Satisfactory | Example |
| 2 | 60 | 0.021 | 0.40 | 0.12 | 2.9 | 720 | 830 | 18 | 80 | 66400 | Satisfactory | Example |
| 3 | 70 | 0.009 | 0.23 | 0.08 | 3.2 | 700 | 790 | 16 | 50 | 39500 | Unsatisfactory | Comparative Example |
| 4 | 80 | 0.050 | 0.52 | 0.07 | 3.2 | 870 | 980 | 18 | 110 | 107800 | Satisfactory | Example |
| 5 | 90 | 0.030 | 0.60 | 0.04 | 3.0 | 680 | 790 | 20 | 130 | 102700 | Satisfactory | Example |
| 6 | 60 | 0.063 | 0.36 | 0.05 | 2.6 | 1010 | 1220 | 14 | 50 | 61000 | Satisfactory | Example |
| 7 | 50 | 0.060 | 0.33 | 0.10 | 2.6 | 980 | 1190 | 14 | 55 | 65450 | Satisfactory | Example |
| 8 | 80 | 0.035 | 0.50 | 0.01 | 3.0 | 720 | 850 | 18 | 50 | 42500 | Poor | Comparative Example |
| 9 | 40 | 0.089 | 0.30 | 0.15 | 3.0 | 1050 | 1260 | 13 | 20 | 25200 | Poor | Comparative Example |
| 10 | 70 | 0.021 | 0.42 | 0.11 | 4.0 | 690 | 810 | 19 | 110 | 89100 | Satisfactory | Example |
| 11 | 75 | 0.045 | 0.44 | 0.06 | 3.0 | 890 | 1010 | 17 | 100 | 101000 | Satisfactory | Example |
| 12 | 40 | 0.009 | 0.24 | 0.15 | 2.8 | 670 | 800 | 17 | 53 | 42400 | Unsatisfactory | Comparative Example |
| 13 | 90 | 0.010 | 0.23 | 0.06 | 2.6 | 660 | 780 | 17 | 50 | 39000 | Unsatisfactory | Comparative Example |
| 14 | 70 | 0.022 | 0.34 | 0.08 | 3.0 | 710 | 830 | 17 | 100 | 83000 | Satisfactory | Example |
| 15 | 80 | 0.041 | 0.49 | 0.06 | 2.4 | 720 | 890 | 17 | 90 | 80100 | Satisfactory | Example |
| 16 | 70 | 0.025 | 0.43 | 0.06 | 2.0 | 710 | 820 | 19 | 120 | 98400 | Satisfactory | Example |
| 17 | 90 | 0.011 | 0.23 | 0.05 | 2.6 | 700 | 800 | 18 | 53 | 42400 | Unsatisfactory | Comparative Example |
| 18 | 50 | 0.083 | 0.32 | 0.13 | 2.8 | 1020 | 1250 | 13 | 55 | 68750 | Satisfactory | Example |
| 19 | 55 | 0.020 | 0.37 | 0.03 | 3.0 | 740 | 860 | 15 | 45 | 38700 | Poor | Comparative Example |
| 20 | 85 | 0.014 | 0.23 | 0.09 | 2.8 | 750 | 850 | 16 | 50 | 42500 | Unsatisfactory | Comparative Example |
| 21 | 60 | 0.010 | 0.24 | 0.08 | 3.0 | 690 | 810 | 17 | 60 | 48600 | Unsatisfactory | Comparative Example |
| 22 | 80 | 0.021 | 0.43 | 0.03 | 2.8 | 710 | 800 | 18 | 60 | 48000 | Poor | Comparative Example |
| 23 | 80 | 0.021 | 0.53 | 0.18 | 2.6 | 690 | 780 | 17 | 40 | 31200 | Unsatisfactory | Comparative Example |

The invention claimed is:

1. A high strength steel sheet comprising:

a chemical composition containing, in mass %,

C: 0.05% to 0.30%,

Si: 0.6% to 2.0%,

Mn: 1.3% to 3.0%,

P: 0.10% or less,

S: 0.030% or less,

Al: 2.0% or less,

N: 0.010% or less, and one or more of Ti, Nb, and V: 0.01% to 1.0% each, with a balance being Fe and incidental impurities;

a ferrite microstructure of 50% or more in area ratio;

a tensile strength (TS) of 780 MPa or more;

a product (TS×λ) of the tensile strength and a hole expansion ratio is 60000 MPa % or more; and a precipitate with a particle size of less than 20 nm, wherein Fe is precipitated as cementite in an amount of 0.04 mass % or more and C* defined by the following Expression (1) and $C^*_p$ defined by the following Expression (2) meet conditions of the following Expressions (3) to (5):

$$C^*=([Ti]/48+[Nb]/93+[V]/51+[Mo]/96+[Ta]/181+[W]/184)\times 12 \quad (1)$$

$$C^*_p=([Ti]_p/48+[Nb]_p/93+[V]_p/51+[Mo]_p/96+[Ta]_p/181+[W]_p/184)\times 12 \quad (2)$$

$$C^*\geq 0.035 \quad (3)$$

$$-0.015\leq [C]-C^*\leq 0.03 \quad (4)$$

$$C^*_p/C^*\geq 0.3 \quad (5)$$

where [M] denotes a content of an element M in the high strength steel sheet in mass %, [C] denotes a content of C in the high strength steel sheet in mass %, and $[M]_p$ denotes a content, with respect to the whole high strength steel sheet, of the element M contained in the precipitate with the particle size of less than 20 nm in mass %, [M] and $[M]_p$ being 0 in the case where the element M is not contained in the high strength steel sheet.

2. The high strength steel sheet according to claim 1, wherein the chemical composition further contains one or more selected from among group (i) to group (iv) below:

group (i): one or more of Mo, Ta, and W: 0.005% to 0.50% each, in mass %;

group (ii): one or more of Cr, Ni, and Cu: 0.01% to 1.0% each, in mass %;

group (iii): Sb: 0.005% to 0.050%, in mass %; and group (iv): one or both of Ca and REM: 0.0005% to 0.01% each, in mass %.

3. A manufacturing method for the high strength steel sheet according to claim 1, the manufacturing method comprising:

a hot rolling step of performing rough rolling and finish rolling on a steel raw material having the chemical composition according to claim 1, to obtain a steel sheet;

a first rapid cooling step of cooling the steel sheet after the finish rolling, at an average cooling rate of 30° C./s or more from completion of the finish rolling to start of a subsequent intermediate slow cooling step;

the intermediate slow cooling step of slow cooling the steel sheet after the first rapid cooling step, from a start temperature of more than 650° C. and 750° C. or less for 1 s to 10 s at an average cooling rate of less than 10° C./s;

a second rapid cooling step of cooling the steel sheet after the intermediate slow cooling step, at an average cooling rate of 10° C./s or more from completion of the intermediate slow cooling step to start of a subsequent coiling step; and the coiling step of coiling the steel sheet after the second rapid cooling step, at a coiling temperature of 350° C. to 500° C., wherein the finish rolling is performed under the following conditions:

a finisher entry temperature of the steel sheet: 900° C. to 1100° C., a total rolling reduction in the finish rolling: 88% or more, a finisher delivery temperature of the steel sheet: 800° C. to 950° C., and a finisher delivery sheet passing rate: 300 m/min or more.

4. The manufacturing method according to claim 3, further comprising a working step of working the steel sheet after the coiling step, at a thickness reduction of 0.1% to 3.0%.

5. A manufacturing method for the high strength steel sheet according to claim 2, the manufacturing method comprising:

a hot rolling step of performing rough rolling and finish rolling on a steel raw material having the chemical composition according to claim 2, to obtain a steel sheet;

a first rapid cooling step of cooling the steel sheet after the finish rolling, at an average cooling rate of 30° C./s or more from completion of the finish rolling to start of a subsequent intermediate slow cooling step;

the intermediate slow cooling step of slow cooling the steel sheet after the first rapid cooling step, from a start temperature of more than 650° C. and 750° C. or less for 1 s to 10 s at an average cooling rate of less than 10° C./s;

a second rapid cooling step of cooling the steel sheet after the intermediate slow cooling step, at an average cooling rate of 10° C./s or more from completion of the intermediate slow cooling step to start of a subsequent coiling step; and the coiling step of coiling the steel sheet after the second rapid cooling step, at a coiling temperature of 350° C. to 500° C., wherein the finish rolling is performed under the following conditions:

a finisher entry temperature of the steel sheet: 900° C. to 1100° C., a total rolling reduction in the finish rolling: 88% or more, a finisher delivery temperature of the steel sheet: 800° C. to 950° C., and a finisher delivery sheet passing rate: 300 m/min or more.

6. The manufacturing method according to claim 5, further comprising a working step of working the steel sheet after the coiling step, at a thickness reduction of 0.1% to 3.0%.

* * * * *